US006935651B2

(12) United States Patent
Krumbeck et al.

(10) Patent No.: US 6,935,651 B2
(45) Date of Patent: Aug. 30, 2005

(54) BINDING SYSTEM FOR AND ON A SKI OR SNOWBOARD

(75) Inventors: Markus Krumbeck, Garmisch-Partenkirchen (DE); Michael Mangold, Farchant (DE)

(73) Assignee: Marker Deutschland GmbH, Eschenlohe (DE)

( * ) Notice: Subject to any disclaimer, the term of this patent is extended or adjusted under 35 U.S.C. 154(b) by 114 days.

(21) Appl. No.: 10/411,509

(22) Filed: Apr. 10, 2003

(65) Prior Publication Data

US 2003/0193171 A1 Oct. 16, 2003

(30) Foreign Application Priority Data

Apr. 11, 2002 (DE) ..... 102 16 041

(51) Int. Cl.[7] ..... A63C 9/00

(52) U.S. Cl. ..... 280/616; 280/617; 280/633; 280/634

(58) Field of Search ..... 280/607, 601, 280/616, 617, 618, 620, 633, 613, 623, 624, 625, 634

(56) References Cited

U.S. PATENT DOCUMENTS 5,344,178 A * 9/1994 Rohrmoser ..... 280/617
5,975,555 A * 11/1999 Lehner et al. ..... 280/618
6,193,262 B1 * 2/2001 Silva ..... 280/607
6,217,055 B1 * 4/2001 Silva ..... 280/607
6,244,616 B1 * 6/2001 Arduin et al. ..... 280/607
6,412,807 B1 * 7/2002 Arduin et al. ..... 380/607
6,454,291 B1 * 9/2002 Hillairet et al. ..... 280/623
6,471,235 B1 10/2002 Luitz et al.
6,616,171 B2 * 9/2003 Kruajitch ..... 280/607
6,631,918 B2 * 10/2003 Silva ..... 280/607
6,679,514 B2 * 1/2004 Luitz et al. ..... 280/607
6,779,810 B1 * 8/2004 Mangold ..... 280/634

FOREIGN PATENT DOCUMENTS

DE 100 398 16 A1 5/1975

* cited by examiner

*Primary Examiner*—Hau Phan
(74) *Attorney, Agent, or Firm*—D. Peter Hochberg; Katherine R. Vieyra; Sean Mellino

(57) ABSTRACT

A binding system for and on skis or snowboards having slider elements that are insertable into a guiderail arrangement and may be secured for front and rear sole holder units by multi-section retaining element. The retaining element is arranged on the skis or on the guiderail arrangement longitudinally between the slider elements.

25 Claims, 3 Drawing Sheets

BINDING SYSTEM FOR AND ON A SKI OR SNOWBOARD

FIELD OF THE INVENTION

The invention relates to a binding system for and on skis or snowboards having a guiderail arrangement, a front slider element of a front boot holder unit to accommodate the front boot holder unit, displaceable therein, a rear slider element of a rear boot holder unit to accommodate the rear boot holder unit, displaceable therein, and a retaining member arranged between the slider elements that is securable on the guiderail arrangement or on an abutment that is stationary relative to the guide rail, having couplings for securing the slider elements in longitudinal direction of the guide rail arrangement.

DESCRIPTION OF THE PRIOR ART

A binding system of such kind is the object of German Patent No. DE 100 398 16 A1. With this known system, a flat strap is provided as a retaining member, the middle area of which is secured to a fixed abutment and the free ends of which are attached to front and rear boot holder units. For adjusting the longitudinal distance between the boot holder units, i.e. for adapting the positions of the boot holder units to the respective length of the sole of the boot to be inserted into the binding, the boot holder units may be displaced relative to the ends of the flat strap connected to the boot holder units by means of freely accessible spindle screws.

In another embodiment, separate strap-like connecting elements are assigned to the boot holder units and may be secured in different positions on an abutment that is shared by both members in order to allow distance between the boot holder units to be adapted to the length of the boot sole.

SUMMARY OF THE INVENTION

The task of the present invention is to produce a binding system which may be easily mounted and is secure against unintentional or unauthorized displacement.

This task is solved according to the present invention by securing the sliding side ends of the couplings in positions that are provided for different distances between the sliding members (also referred to as slider members or sliders or sliding elements) and which may only be adjusted when the slider or sliders are separated from the guiderail arrangement.

The invention is based on the general idea of allowing the longitudinal distance between the sliding members to be adapted to the respective boot size or sole length only when the binding system is dismantled i.e. when the sliding members have been removed from the guiderail arrangement. This way, a very high degree of security against any unintentional or undesirable adjustment of the binding system is assured.

In such an arrangement, it is advantageous if the sliding members may be connected to the couplings using plug-in type connectors that may be inserted and removed without the use of tools. In a particularly suitable configuration of the invention, the inserted condition of such connectors may be assured when the sliders are inserted in the guiderail arrangement simply by ensuring that the couplings are inserted on the underside of the sliders and inside the guiderail arrangement, i.e. when the slider elements have been slid into the guiderail arrangement, there is no room for the plug-in type connector to become disconnected.

In a further advantageous configuration of the invention, the retaining element may be constructed in multiple sections and may have a first coupling member connected with the first coupling and a second coupling member that is connected with the other coupling and which may be connected to the first coupling member. Thus each sliding member may be connected to its coupling independently of the other sliding member so that the corresponding assembly is particularly simple.

In addition, the coupling members may engage with one another in the form of a clip or snap lock, preferably in such manner that the clipped or locked condition may be achieved by pushing the coupling members towards each other in the longitudinal direction of the guiderail arrangement. Thus it is easily possible to insert the sliding elements with their couplings independently of one another into the guiderail arrangement at either end thereof.

A locking element preferably cooperating positively with both coupling members, e.g. a lock bolt that may be attached to the guiderail arrangement or the abutment, is used to secure the retaining element and/or the coupling members.

In the rest of the text, the description refers to preferred features of the invention as characterised in the claims and the following explanation of the drawing, on the basis of which a particularly preferred embodiment of the invention will be described in detail.

DETAILED DESCRIPTION OF THE INVENTION

Figure 1:
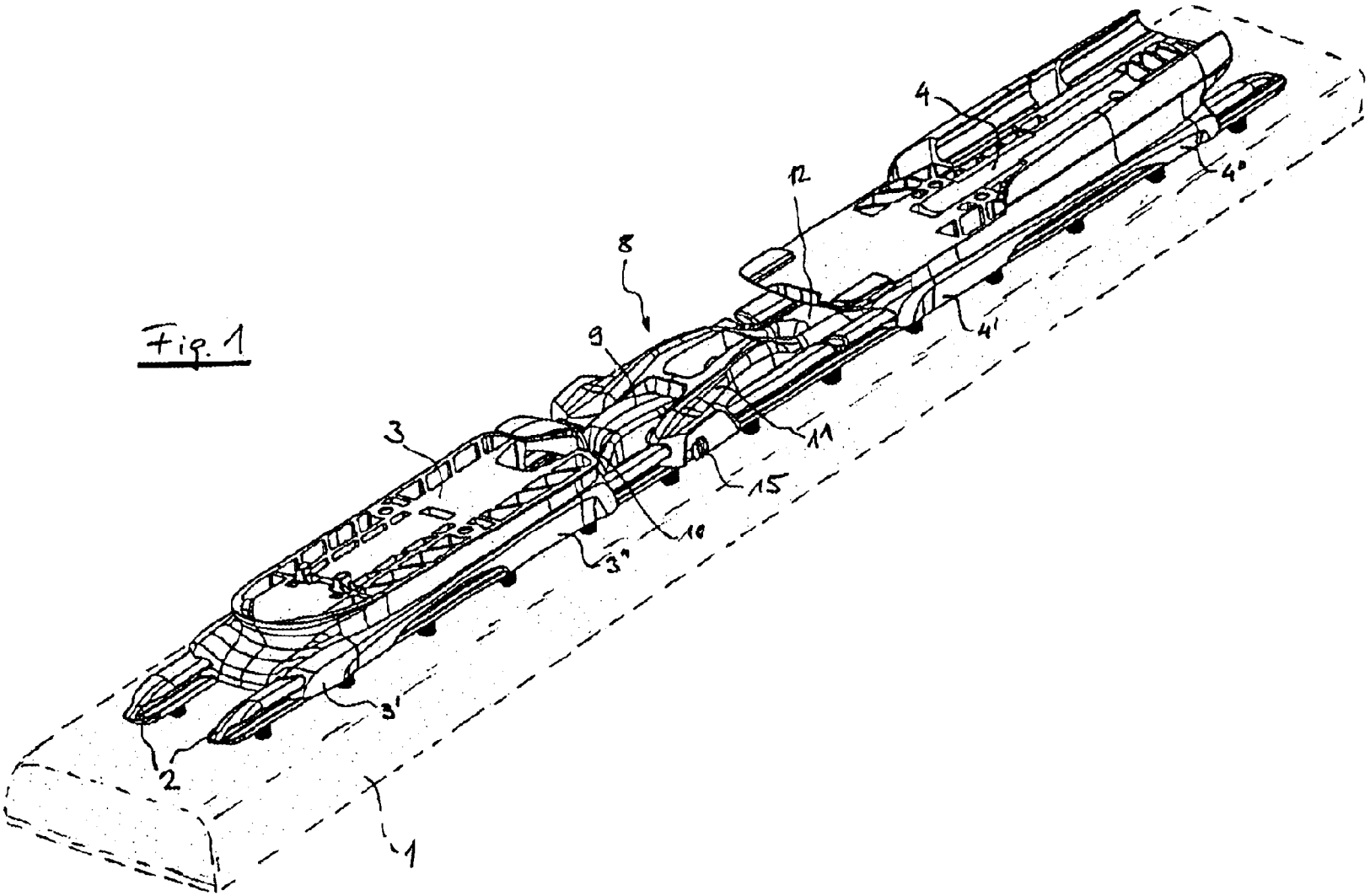
FIG. 1 is a perspective representation of the guiderail arrangement with front and rear sliding members and the retaining element arranged therebetween.

Two parallel guiderail arrangements 2 are arranged in a manner known in the art on a ski 1—indicated only by the dashed lines in FIG. 1. These are affixed by both non-positive and positive means via pins conformed therewith and engaging securely with corresponding holes in the ski, and also by material means via adhesion or otherwise to the top of the ski.

Guiderails 2 essentially have a double "T" shaped profile with guidance grooves conformed on both sides of the rails.

Figures 2, 3:
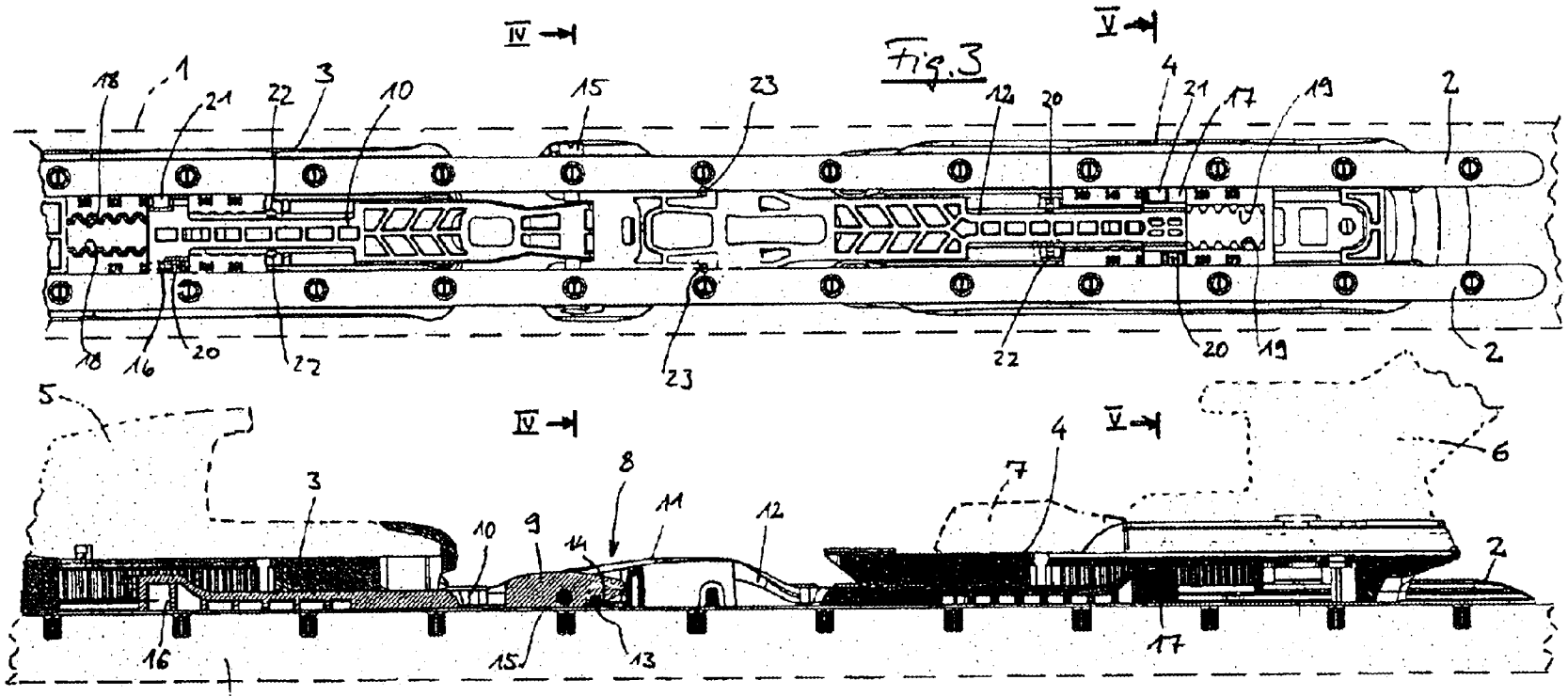
FIG. 2 is a vertical longitudinal section of the aforementioned arrangement.
FIG. 3 is a plan view of the underside of the aforementioned arrangement.

Guiderails 2 serve as a movable seating for a front sliding member 3 and a rear sliding member 4. These sliding members 3 and 4 are constructed as platforms to accommodate a front boot holder unit 5—indicated only by dashed lines in FIG. 2—and a rear boot holder unit 6 of and entirely conventional ski binding, wherein rear sliding member 4 also serves to accommodate a ski brake, of which only the base part 7 supported on rear sliding member 4 is represented in FIG. 2.

Front boot holder unit 5 is securely arranged on front sliding member 3. On the other hand, rear boot holder unit 6 is movable on rear sliding element 4 in the longitudinal direction thereof and against the force of a compression spring resistance pushing rear boot holder unit 6 in the direction of front boot holder unit 5 against the heel extremity of the sole of a ski boot—not shown—that is detachably secured by boot holder units 5 and 6. The compression spring resistance ensures that boot holder units 5 and 6 remain positively engaged with the sole of the ski boot even with flexing movement of ski 1 and thus undesirable tensions between the ski boot sole and ski 1 are avoided.

Sliding members 3 and 4 are secured with practically no vertical or transverse play on guiderails 2. To this end, front areas 3' and 4' and rear areas 3" or 4" of sliding members 3 and 4 engage and are profiled reciprocally with the rail profile which enables them to engage in the rail-side grooves on the sides of the rails. In a middle area, i.e. between front and rear area 3' and 3" of front sliding member 3 and between areas 4' and 4" of rear sliding member 4, guiderails 2 have no positive locking engagement with the slider members. This facilitates flexing movements of ski 1.

In the longitudinal direction of the ski, sliding members 3 and 4 are secured via a retaining element 8 consisting of multiple sections.

This retaining element 8 essentially consists of a front coupling member 9, which is conformed integrally with a front coupling 10 that may be attached to front sliding member 3, and of a rear coupling member 11, which is conformed integrally with a rear coupling 12 that may be attached to rear sliding member 4. Coupling members 9 and 11 may be connected together in a locking engagement if coupling members 9 and 11 are pushed towards each other in the longitudinal direction of guiderails 2. For this purpose, a catch mechanism 13 is conformed on a base area of rear coupling member 11, into which front coupling member 13 is able to engage from above with a mating locking mechanism 14. Tapered sections are provided on both profiles 13 and 14, so that catching and mating profiles 13 and 14 initially slide towards each other and may then lock together when coupling members 9 and 11 are pushed towards each other.

Figure 4:
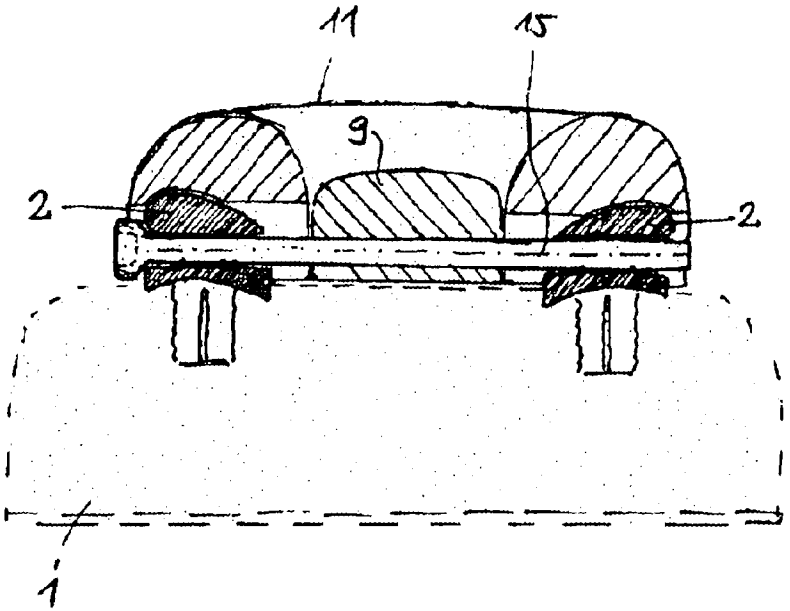
FIG. 4 is a cross-section along line IV—IV in FIG. 3.

The area of catch mechanism 13 on rear coupling member 11 is securely retained on guiderails 2 in the vertical and transverse directions, as is particularly evident in FIGS. 1 and 4. On the other hand, coupling member 9 is "cantilevered" on its coupling 10, so that it may be deflected upwards by spring action when the tapered sections of catch and mating mechanisms 13 and 14 slide towards one another. Subsequently, front coupling member 9 may be moved downwards to lock catch and mating mechanisms 13 and 14.

When locked together, coupling members 9 and 11 are secured jointly to the ski by a retaining pin or a locking pin 15, which may be inserted into corresponding transverse holes in guiderails 2 when these transverse holes align with a transverse hole provided in front coupling member 9 and with downwardly open transverse slots on rear coupling member 11. These transverse slots are provided on legs of rear coupling member 11 that laterally enclose front coupling member 9 in a section of rear coupling member 11 that moves essentially without vertical or transverse play on guiderails 2. This serves to ensure that rear coupling member 11 cannot become disengaged from retaining pin 15. In addition, retaining pin 15 acts as a hinge pin 15 inside the transverse hole in front coupling member 9, with which front coupling member 9 is secured firmly to guiderails 2 and relative to rear coupling member 11 to form a hinged connection between front coupling member 9 and rear coupling member 11.

Figure 5:
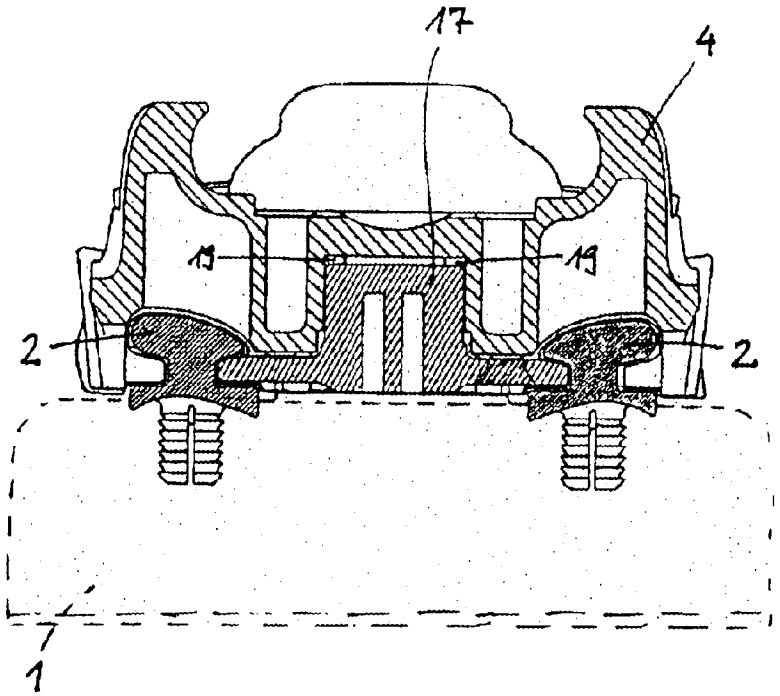
FIG. 5 is a cross-section along line V—V in FIG. 3.

Couplings 10 and 12 each possess slider-side endpieces 16 and 17, which serve to attach couplings 10 and 12 to respective slider elements 3 and 4. Endpieces 16 and 17 are each guided with flange-like lateral shaped elements conformed therewith in the opposing longitudinal grooves on the interior sides of guiderails 2, as is shown in FIG. 5 with the example of endpiece 17. Above these guidance flanges, each endpiece 16 and 17 has vertical lateral surfaces with a serrated profile, i.e. the aforementioned lateral surfaces are provided with multiple consecutively arranged vertical ribs. The aforementioned serrations engage with positive locking into matching serrations 18 and 19 on slider elements 3 and 4. These serrations 18 and 19 form the lateral walls of downwardly open longitudinal channels in slider elements 3 and 4. Endpieces 16 and 17 of couplings 10 and 12 may accordingly be introduced into the aforementioned channels of slider elements 3 and 4 from below, such that endpieces 16 and 17 may be inserted optionally at various positions in the longitudinal direction of slider elements 3 and 4.

By appropriate selection of the insertion positions, the longitudinal distance is determined between slider elements 3 and 4 and thus also between the boot holder units 5 and 6 arranged thereon.

As may be seen in FIG. 3, measurement numbers 270, 280 etc., are indicated on the underside of the slider elements 3 and 4, which are chosen to reflect the length, in mm, of normal, standardized ski boot soles. Windows 20 and 21 are arranged on endpieces 16 and 17 of couplings 10 and 12, through which the measurement numbers are visible when endpieces 16 and 17 are in the corresponding positions on the slider elements 3 and 4. In the example of FIG. 3, the measurement numbers 310 appear in the each of the corresponding windows 20. This indicates that couplings 10 and 12, with associated slider elements 3 and 4, are adapted to a position corresponding to a ski boot sole having a length of 310 mm.

In order to mount the binding system according to the invention the first boot holder units 5 and 6 are mounted on the associated slider elements 3 and 4, and in the preferably prepared fastening positions. This ensures that the parts of the boot holder units cooperating with the boot sole assume a reference position relative to slider elements 3 and 4. Thereafter, couplings 10 and 12 are connected with the slider elements 3 and 4. For this purpose, endpieces 16 and 17 of couplings 10 and 12 are inserted into the respective slider-side serrations 18 and 19 on the underside of the respective slider element 3 or 4 in accordance with the respective length of the ski boot sole. The sole length corresponding in each case to the positioning made of couplings 10 and 12 on slider elements 3 and 4 can be read in windows 20 and 21.

The positioning of couplings 10 and 12 is secured by the fact that couplings 10 and 12 are lockable on the respective slider elements 3 and 4. For this purpose, catch elements 22 may be conformed on slider elements 3 and 4. On the other hand, it is also entirely possible to arrange corresponding catch elements on couplings 10 and 12, by which couplings 10 and 12 may each be locked on slider elements 3 and 4. If required, separate retaining elements, for example clips or the like, may also be used to lock couplings 10 and 12 with slider elements 3 and 4.

Now, slider elements 3 and 4 with couplings 10 and 12 positioned thereon are slid into guiderails 2 on the ski 1. Then, slider elements 3 and 4 are pushed together with their couplings 10 and 12, so that coupling members 9 and 11 of couplings 10 and 12 engage. Slider members 3 and 4 are locked together via their couplings 10 and 12.

Now slider elements 3 and 4 are moved jointly so that retaining pin 15 may be installed. Locating the mounting position is made easier by the fact that engaging elements are provided on one of couplings 10 or 12—on coupling 12 in the example shown—which cooperate with engagement recesses 23 on guiderails 2. As soon as this locked position has been set, retaining pin 15 may be pushed without effort into the openings or recesses that are now aligned with each other to accommodate retaining pin 15 on guiderails 2 and on coupling members 9 and 11, and secured therein.

Subsequent alteration of the binding arrangement to accept ski boots having a different sole length may be effected without difficulty: retaining pin 15 must simply be dismantled again. Slider elements 3 and 4 may then be withdrawn from guiderails 2 together with couplings 10 and 12. Now, endpieces 16 and 17 of couplings 10 and 12 are repositioned on slider elements 3 and 4 according to the length of the currently desired ski boots. Then, slider elements 3 and 4 may be reinstalled on the ski together with their couplings 10 and 12 as described in the aforegoing.

In all cases, it is possible to effect a modified assembly instead of the standard assembly previously described, for example to improve the slaloming or deep snow properties of the ski.

For especially good slaloming properties, it is normally desirable for the ski boot to be displaced somewhat forward relative to a standard position on the ski. In order to allow this, coupling 10, with its endpiece 16, may be positioned at a position intended for a longer sole length, for example at the position for a sole length of 320 mm, if the actual sole length is 310 mm. Conversely, coupling 12 with its endpiece 17 on rear slider element 4 is inserted in a position for a smaller sole length, here set at 300 mm. Now when slider elements 3 and 4 with the couplings positioned as just described are secured in guiderails 2, the ski boot is held on the ski in a position that is somewhat advanced.

In correspondingly reverse manner, the position of the ski boots may be transferred somewhat backwards if it is desired to lend the ski to especially good qualities in deep snow.

The invention may be modified from the embodiment shown in the drawing in many ways. For example, guiderails 2 may have practically any profile that allows the components to be inserted in the guiderails to move along the rails with no vertical or transverse play. In particular, guiderails 2 may have a C-shape or a shape with a longitudinal groove on only one rail flank, wherein the longitudinal groove is preferably arranged on the flanks of guiderails 2 that face each other.

In addition, it is also possible to arrange guiderails 2 in a depression on the top side of the ski, for example in an indentation provided on the top side of the ski, wherein guiderails 2 may form the longitudinal borders of the indentation.

It is also possible to provide only a single guiderail, which may for example be arranged in the middle of the ski.

The two couplings 10 and 12 may be connected non-detachably to one another and/or may be connected to a single-piece retaining element 8.

Instead of retaining pin 15, other retaining elements may also be provided. In particular, it is also possible to lock retaining element 8 and/or coupling members 9 and 11 directly on the ski 1 instead of on the guiderail or guiderails 2.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications and variations that fall within the spirit and scope of the appended claims.

What is claimed is:

1. A binding system for and on skis or snowboards, said system comprising:

a guiderail arrangement having a plurality of recesses and multiple locking positions;

a front slider element of a front boot holder unit to accommodate the front boot holder unit, displaceable therein;

a rear slider element of a rear boot holder unit to accommodate the rear boot holder unit, displaceable therein; and a retaining element arranged between the slider elements that is securable on said guiderail arrangement, having couplings for securing the slider elements in a longitudinal direction of the guide rail arrangement, wherein said couplings each comprise slider-side endpieces for attaching said couplings to said slider elements; and wherein said slider-side endpieces are attachable to said slider elements at multiple positions provided for different distances between the slider elements, said positions being changeable only when said slider elements are separated from the guide rail arrangement.

2. The binding system according to claim 1, wherein the guiderail arrangement is inseparably connected to each of the skis and is conformed as an integral component of each of the skis.

3. The binding system according to claim 1, wherein said retaining element of said binding system further comprises a first coupling member and a second coupling member, and wherein said retaining element comprises multiple sections whereby said first coupling member connected to the first of said couplings and second coupling member is connected to the other of said couplings and which is connectable to the first coupling member.

4. The binding system according to claim 3, and further including a mechanism selected from the group consisting of a catch and a snap lock, whereby said coupling members cooperate with said mechanism to form a clipped or locked condition.

5. The binding system according to claim 4, wherein the clipped or locked condition is achieved by pushing the coupling members towards each other in the longitudinal direction of the guiderail arrangement.

6. The binding system according to claim 5, and further including a locking element that locks both of said coupling members on said guiderail arrangement, wherein the coupling members are lockable by said locking element.

7. The binding system according to claim 6, and further comprising an abutment stationary to said guiderail arrangement, and wherein said locking element locks both of said coupling members on said abutment, wherein the coupling members are lockable by said locking element.

8. The binding system according to claim 1, and further including a retaining pin, wherein the retaining element, or the coupling members thereof, is securable by said retaining pin, which penetrates said recesses in the guiderail arrangement and on the retaining element or the coupling members thereof.

9. The binding system according to claim 1, wherein each coupling is attachable to the underside of its associated slider element.

10. The binding system according to claim 1, wherein said guiderail arrangement has shaped portions, and wherein the slider element is inserted into the guiderail arrangement, each coupling attached to the associated slider elements is affixed to the associated slider element, each coupling being engaged with said shaped portions of the guiderail arrangement to prevent said couplings from being lost and rendering said couplings movable essentially without vertical or transverse play.

11. The binding system according to claim 1, wherein the slider elements are moved along the guiderail arrangement essentially without vertical and transverse play in front of and behind their connection to the associated coupling.

12. The binding system according to claim 1, wherein the retaining element and at least one of said slider elements is lockably secured at any one of said multiple locking positions on the guiderail arrangement in a position in which the retaining element, or the members thereof, is fixable on the ski and on the guiderail arrangement.

13. The binding system according to claim 12, and further comprising multiple securing positions corresponding to said multiple locking positions.

14. The binding system according to claim 1, wherein the guiderail arrangement is inseparably connected to the ski.

15. The binding system according to claim 1, wherein the guiderail arrangement is conformed as an integral component of the ski.

16. The binding system according to claim 1, wherein at least a part of the retaining element and at least one of said slider elements are lockably secured at any one of said multiple locking positions on the guiderail arrangement in a position in which the retaining element, or the members thereof, is fixable on the ski.

17. The binding system according to claim 1, wherein at least a part of the retaining element and at least one of said slider elements are lockably secured at any one of said multiple locking positions on the guiderail arrangement in a position in which the retaining element, or the members thereof, is fixable on the guiderail arrangement.

18. The binding system according to claim 1, wherein at least a part of the retaining element is lockably secured at any one of said multiple locking positions on the guiderail arrangement in a position in which the retaining element, or the members thereof, is fixable on the ski and on the guiderail arrangement.

19. The binding system according to claim 1, wherein at least a part of the retaining element is lockably secured at any one of said multiple locking positions on the guiderail arrangement in a position in which the retaining element, or the members thereof, is fixable on the ski.

20. The binding system according to claim 1, wherein at least a part of the retaining element is lockably secured at any one of said multiple locking positions on the guiderail arrangement in a position in which the retaining element, or the members thereof, is fixable on the guiderail arrangement.

21. The binding system according to claim 1, wherein at least one of said slider elements is lockably secured at any one of said multiple locking positions on the guiderail arrangement in a position in which the retaining element, or the members thereof, is fixable on the ski and on the guiderail arrangement.

22. The binding system according to claim 1, wherein at least one of said slider elements is lockably secured at any one of said multiple locking positions on the guiderail arrangement in a position in which the retaining element, or the members thereof, is fixable on the ski.

23. The binding system according to claim 1, wherein at least one of said slider elements is lockably secured at any one of said multiple locking positions on the guiderail arrangement in a position in which the retaining element, or the members thereof, is fixable on the guiderail arrangement.

24. The binding system according to claim 1, wherein said slider elements each further comprise a serration for securing said slider-side endpieces to said slider elements.

25. A binding system for and on skis or snowboards, said system comprising:

a guiderail arrangement having a plurality of recesses and multiple locking positions;

a front slider element of a front boot holder unit to accommodate the front boot holder unit, displaceable therein;

a rear slider element of a rear boot holder unit to accommodate the rear boot holder unit, displaceable therein;

a retaining element arranged between the slider elements that is securable on said guiderail arrangement, having couplings for securing the slider elements in a longitudinal direction of the guide rail arrangement, wherein said couplings each possess slider-side endpieces for attaching said couplings to said slider elements; and a retaining pin for securing said retaining element, or said couplings of said retaining element, to the ski, said retaining pin penetrating said recesses in said guiderail arrangement and on the retaining element or the coupling members of said retaining element, wherein said retaining pin effects a hinged connection between said coupling members of said retaining element; and wherein said slider-side endpieces are attachable to said slider elements at multiple positions provided for different distances between the slider elements, said positions being changeable only when said slider elements are separated from the guide rail arrangement.

* * * * *